US011444392B2

(12) United States Patent
Tuerkekoele et al.

(10) Patent No.: US 11,444,392 B2
(45) Date of Patent: Sep. 13, 2022

(54) CONDUCTOR CONNECTION TERMINAL

(71) Applicant: WAGO Verwaltungsgesellschaft mbH, Minden (DE)

(72) Inventors: Muhammet Ali Tuerkekoele, Minden (DE); Thomas Witte, Porta Westfalica (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/175,706

(22) Filed: Feb. 15, 2021

(65) Prior Publication Data

US 2021/0257754 A1 Aug. 19, 2021

(30) Foreign Application Priority Data

Feb. 13, 2020 (DE) ..... 20 2020 100 782.3

(51) Int. Cl.
*H01R 4/48* (2006.01)

(52) U.S. Cl.
CPC ..... *H01R 4/4836* (2013.01); *H01R 4/4845* (2013.01)

(58) Field of Classification Search
None
See application file for complete search history.

(56) References Cited

U.S. PATENT DOCUMENTS

| | | | | |
|---|---|---|---|---|
| 10,014,594 | B1 * | 7/2018 | Wu | H01R 4/4845 |
| 10,230,179 | B2 * | 3/2019 | Wilinski | H01R 9/223 |
| 10,367,271 | B1 * | 7/2019 | Wu | H01R 4/4836 |
| 10,367,272 | B2 * | 7/2019 | Witte | H01R 4/4836 |

FOREIGN PATENT DOCUMENTS

| | | | |
|---|---|---|---|
| CN | 207938929 | U | 10/2018 |
| DE | 202012103581 | U1 | 11/2012 |
| DE | 102013110789 | B3 | 12/2014 |
| DE | 202015103176 | U1 | 6/2015 |
| DE | 102016115601 | A1 | 3/2018 |
| DE | 202017106590 | U1 | 1/2019 |
| DE | 102017121543 | A1 | 3/2019 |
| DE | 102017127378 | A1 | 5/2019 |
| DE | 102018122806 | A1 | 5/2019 |

* cited by examiner

*Primary Examiner* — Ross N Gushi
(74) *Attorney, Agent, or Firm* — Muncy, Geissler, Olds & Lowe, P.C.

(57) ABSTRACT

A conductor connection terminal with at least one spring-loaded clamping connection for connecting an electrical conductor via a spring-loaded clamping. The spring-loaded clamping connection has at least one clamping point for clamping the electrical conductor which is formed with a clamping leg of a clamping spring. The conductor connection terminal has a manual actuating element which, as a result of manual actuation, can be moved from at least a closed position, in which the clamping point is closed, to an open position, in which the clamping point is open, and vice versa. The conductor connection terminal comprises a movably mounted control element by means of which the manual actuating element is mechanically coupled to the clamping spring, so that, as a result of manual actuation of the manual actuating element, the clamping point can be opened and closed via the control element.

15 Claims, 10 Drawing Sheets

CONDUCTOR CONNECTION TERMINAL

This nonprovisional application claims priority under 35 U.S.C. § 119(a) to German Patent Application No. 20 2020 100 782.3, which was filed in Germany on Feb. 13, 2020 and which is herein incorporated by reference.

BACKGROUND OF THE INVENTION

Field of the Invention

The present invention relates to a conductor connection terminal with at least one spring-loaded clamping connection for connecting an electrical conductor via a spring-loaded clamping.

Description of the Background Art

A conductor connection terminal is known, for example, from DE 10 2017 121 543 A1. The invention is based on the object of specifying a further improved conductor connection terminal.

SUMMARY OF THE INVENTION

It is therefore an object of the present invention to provide a conductor connection terminal with at least one spring-loaded clamping connection for connecting an electrical conductor via a spring-loaded clamping, wherein the spring-force clamping connection comprises at least one clamping point which is formed with a clamping leg of a clamping spring for clamping of the electrical conductor, the conductor connection terminal has a manual actuating element which, as a result of manual actuation, can be moved at least from a closed position in which the clamping point is closed to an open position in which the clamping point is open, and vice versa, and the conductor connection terminal has a movably mounted control element by means of which the manual actuating element is mechanically coupled to the clamping spring so that the clamping point can be opened and closed as a result of manual actuation of the manual actuating element via the control element.

In an exemplary embodiment, the conductor connection terminal has a manual actuating element that has a restoring contour which comes into contact with the control element at least when the manual actuating element is moved from the open position to the closed position, wherein the control element is movable from the open position to the closed position by means of the restoring contour. The invention has the advantage that the conductor connection terminal can be actuated with regard to the opening of the clamping point without a separate actuating tool that does not belong to the conductor connection terminal. The clamping point can thus be opened and closed exclusively by elements of the conductor connection terminal, namely the actuating element and the control element. Accordingly, no actuation channel is required for inserting such a tool into the housing. Accordingly, the control element can be arranged completely within the housing, that is to say encapsulated on the outside by the housing. The actuating lever can also be used to provide a visual display of the actuation state of the conductor connection terminal.

By means of the restoring contour, the control element can be actively moved back into the closed position using the manual actuating element. A defined end position of the control element can thus be assumed particularly reliably. Regardless of whether an electrical conductor is connected to the clamping point or not, in the closed position, the control element is always in the same position or a position relative to the other components of the conductor connection terminal, for example the actuating element or an insulating housing.

In addition to the restoring contour, the manual actuating element can also have an actuating contour which comes into contact with the control element at least when the manual actuating element is moved from the closed position to the open position, wherein the control element is movable from the closed position to the open position by means of the actuating contour. The restoring contour and the actuating contour can be arranged, for example, on surfaces of the actuating element that are opposite one another or that point away from one another.

The manual actuating element can be designed as an actuating lever, for example, and the control element as a lever handle. The actuating lever is preferably pivotably mounted in an insulating material housing of the conductor connection terminal, whereas the lever handle is, for example, preferably accommodated in the insulating material housing so as to be at least predominantly linearly displaceable.

The clamping spring can exert a restoring force on the control element at least in some areas, by means of which the restoring movement of the control element from the open position to the closed position caused by the restoring contour is supported at least in some areas. Accordingly, the restoring movement of the control element from the open position to the closed position does not have to be effected exclusively by the manual actuating element via its restoring contour, but can at least partially also be effected by the restoring force of the clamping spring. In this case, the clamping spring can exert a restoring force on the control element over the entire return path of the control element, or over one or more subsections of this return path. The clamping spring can exert the restoring force directly on the control element in that the clamping spring, for example the clamping leg, touches the control element. The clamping spring can also exert the restoring force on the control element indirectly, that is to say via at least one further component of the conductor connection terminal.

The forces which act on the control element between the actuating element and the clamping spring can be exclusively compressive forces. A loading of the control element by tensile forces is thus avoided, so that no tensile stresses are generated in the control element, at least not by the manual actuating element and the clamping spring.

The control element can be completely shielded from the outside environment by components of the conductor connection terminal. This has the advantage that the control element is well protected from any environmental influences. In particular, the control element is protected from moisture and contamination.

The clamping spring can in principle be designed as desired. For example, the clamping spring can be designed like a loop spring, for example in such a way that a partial area of the clamping spring has an opening for the passage of the electrical conductor to be connected.

The clamping spring can have at least one recess through which the control element extends at least in certain positions. This has the advantage that the actuating mechanism with the manual actuating element and the control element is also compatible with a loop spring-like design of the clamping spring, as mentioned above. The recess can be arranged in the same part of the clamping spring as the opening which is used to lead through the electrical conductor. The opening and the recess can also merge into one another and form a common opening.

The clamping spring can, for example, proceed from the contact leg to merge into a connecting leg, wherein the connecting leg merges into a spring arc and the spring arc merges into the clamping leg. An opening for the passage of the electrical conductor can be present in the connecting leg. In addition, the mentioned recess can be present in the connecting leg, through which the control element extends at least in certain positions.

The manual actuating element can be coupled to the control element via a connection arrangement which has at least one connection pin and a pin receptacle assigned to the connection pin, in which the connection pin engages. This allows for a mechanically reliable and easy-to-implement connection of the actuating lever with the control element. There can be a single arrangement of connecting pins and associated pin receptacle, or several such arrangements, for example one arrangement each of connecting pin and pin receptacle on two mutually facing sides of the control element.

The pin receptacle can have an elongated groove or an elongated slot, wherein the connecting pin is guided in the elongated groove or the elongated slot such that it can move longitudinally. In this way, additional degrees of freedom of movement are provided between the actuating element and the control element. This has the advantage that the actuating element and the control element can have different types of movement characteristics, for example a linear movement on the one hand and a pivoting movement on the other. The elongated groove or slot can be open at one end. In this way, the assembly of the conductor connection terminal is simplified, in particular the assembly of the actuating element with the control element.

The manual actuating element can have a manual actuation section and a connecting section which protrudes from the manual actuation section and is coupled to the control element. The connecting section can, for example, protrude at an angle from the manual actuation section. In this way, the actuating element can be designed, for example, as an angular actuating lever (angle lever).

For example, a part of the aforementioned connection arrangement can be arranged on the connecting section, for example a connection pin or a pin receptacle. The respective counterpart, that is to say the pin receptacle or the connecting pin, is then present on the control element. For example, a connecting pin which protrudes towards the connecting section and engages in a pin receptacle on the connecting section can be present on the control element.

The connecting section can run laterally along the clamping spring. This is conducive to a compact construction of the conductor connection terminal. The manual actuating element can in this way be arranged at least partially overlapping or nesting with parts of the contact insert, in particular the clamping spring.

The conductor connection terminal can have a guide contour for the forcible guidance of the movement of the control element caused by the manual actuating element. A desired movement pattern of the control element can be ensured by the guide contour, for example a linear guide, an arcuate guide or a combination thereof. For this purpose, the control element can have a guide extension which is mounted in the guide contour and is longitudinally movable in the guide contour. When the control element is moved from the open position to the closed position and vice versa, the guide extension is moved back and forth in the guide contour.

The conductor connection terminal can have a conductor insertion channel through which an electrical conductor to be connected can be inserted into the conductor connection terminal and guided to the clamping point. This allows for safe and user-friendly contacting of the electrical conductor.

The control element can have an impingement area that applies force on the clamping spring, wherein the impingement area is arranged closer to a central axis of the conductor insertion channel than the guide contour. This is also beneficial for a compact design of the conductor connection terminal. The control element can thus have a stepped shape in which a specific area that is located in the guide contour, for example the guide extension, is arranged at a different height than the impingement area.

The control element can be arranged on the side of the conductor insertion channel facing away from the clamping point. This has the advantage that an electrical conductor, which is clamped to the clamping point, is located between the control element and a busbar section of the conductor connection terminal that has the clamping point. In this way, the control element cannot come into conflict with the electrical conductor; in particular, it does not hinder the introduction of the electrical conductor into the conductor connection terminal towards the clamping point.

The conductor connection terminal can have a busbar on which an electrical conductor can be clamped by means of the clamping spring at the clamping point. Such a busbar allows for the transmission of large currents via the conductor connection terminal.

The clamping spring can have a contact leg via which the clamping spring is supported against a clamping force of a clamping leg, wherein the contact leg is fixed to the busbar or a component coupled to the busbar. In this way, a self-supporting spring-loaded clamping connection of the conductor connection terminal can be provided. The forces of the clamping spring are thus kept away from the material of the housing of the conductor connection terminal, so that the housing material is not exposed to high loads.

The control element can be moved predominantly in a translatory manner and the manual actuating element can be moved predominantly in a rotary manner. In this way, a haptically pleasant pivoting movement of the manual actuating element, which is common in conductor connection terminals, can be combined with lever actuation of the clamping spring.

The actuation path and the type of actuation of the manual actuating element can, for example, be such that the manual actuating element is automatically held in the open position, possibly without additional locking elements. This can be implemented, for example, by an over-center position of the manual actuating element in the open position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
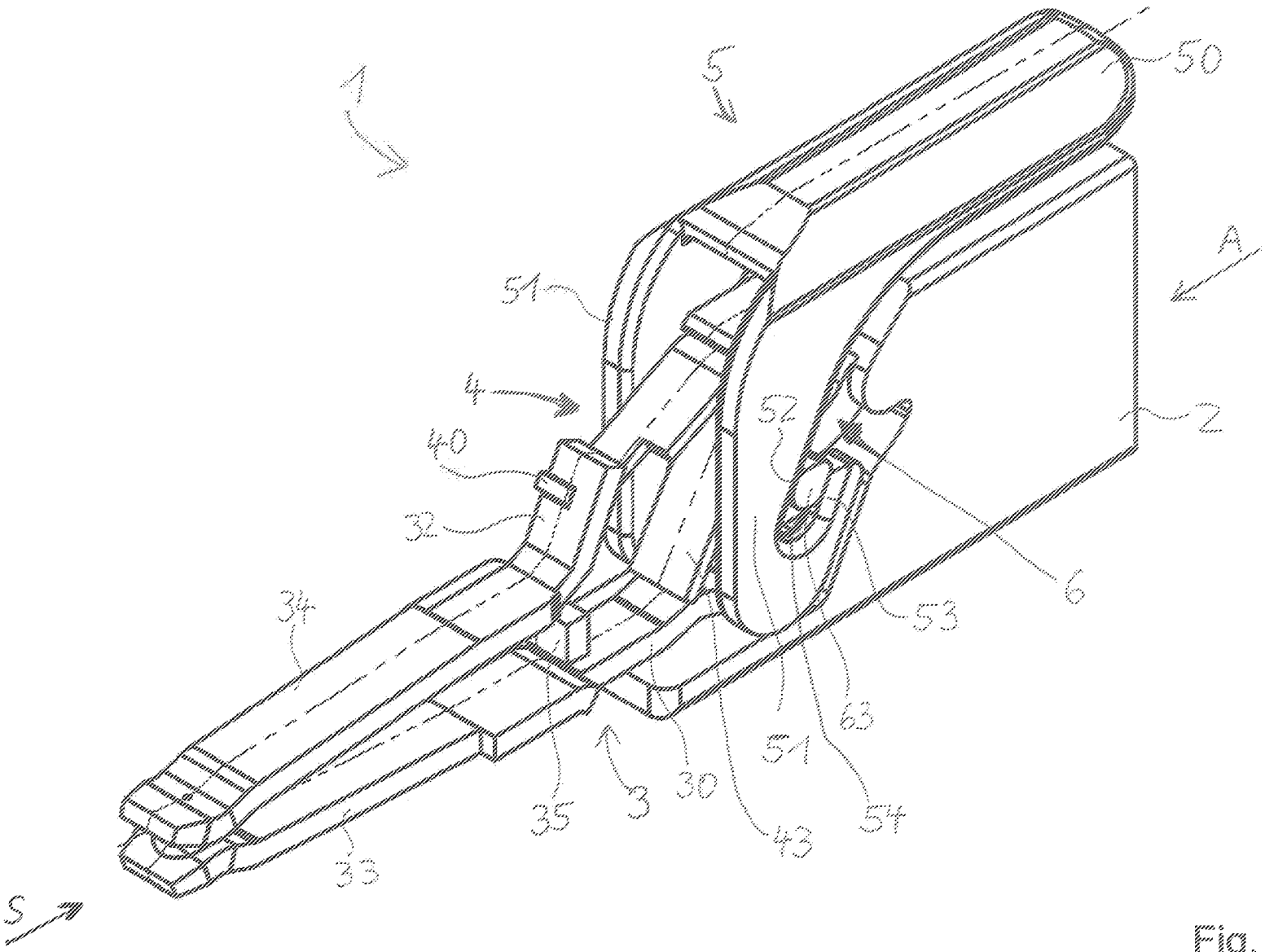
FIG. 1 shows a conductor connection terminal in a perspective view.

FIG. 1 shows a conductor connection terminal 1, which has a housing part 2, a busbar 3, a spring-loaded clamping connection with a clamping spring 4, a manual actuating element 5 and a movably mounted control element 6. The housing part 2 can be part of a multi-part housing of the conductor connection terminal 1, e.g. a cover part or a closure part that is connected to a further housing part to form the housing of the conductor connection terminal 1. This is explained by way of example with reference to FIGS. 10 and 11.

The busbar 3 has a busbar section 30 at which a clamping point is formed with a clamping leg 43 of the clamping spring 4, at which an electrical conductor can be clamped by means of the spring force of the clamping spring 4. The busbar 3 extends from the busbar section 30 to a plug-in connection formed in one piece with the busbar section 30, which can be formed, for example, by two contact tongues 33, 34 in the manner of a fork contact. A not-shown mating contact, for example in the formation of a pin contact or a blade contact, can be inserted in the plug-in connection from a mating side S. As can be better seen in FIG. 2, the contact tongues 33, 34 are connected to one another via a vertical section 31 of the busbar 3. An extension 35 angled with respect to the vertical section 31 also protrudes from the vertical section 31, which extends transversely to the vertical section 31 and which forms a conductor stop for the electrical conductor to be inserted into the conductor connection terminal 1.

The vertical section 31 or the contact tongue 34 also extends into a holding section 32 of the busbar 3, wherein the holding section 32 is arranged on the side of the plug-in connection facing away from the plug-in side S, preferably predominantly opposite the busbar section 30. A contact leg 40 of the clamping spring 4 can be fixed on the holding section 32.

The manual actuating element 5 is designed, for example, in the manner of an actuating lever. The actuation element 5 has a manual actuation section 50 on which the actuation element 5 can be actuated manually by the user, for example an actuation handle. A connecting section 51 protrudes from the manual actuating section 50, for example in the form of two side walls which are spaced apart from one another and which extend laterally along the clamping spring 4.

On the actuating element 5, in particular in the area of the connecting section 51, there is an actuating contour 53 and a restoring contour 52. The actuating contour 53 and the restoring contour 52 run at least in sections next to one another, for example at least substantially parallel to one another. As a result, a slot open on one side is formed in this exemplary embodiment. Alternatively, however, the slot can be designed to be closed. A connecting pin 63 of the control element 6 is located in this slot between the actuating contour 53 and the restoring contour 52. The connecting pin 63 protrudes laterally from the control element 6 and is arranged between the actuating contour 53 and the restoring contour 52. In this way, the actuating contour 53 and the restoring contour 52 together form a pin receptacle 54. The actuating element 5 and the control element 6 are thus coupled to one another, in particular mechanically coupled to one another via the pin receptacle 54 and the connecting pin 63.

Figure 2:
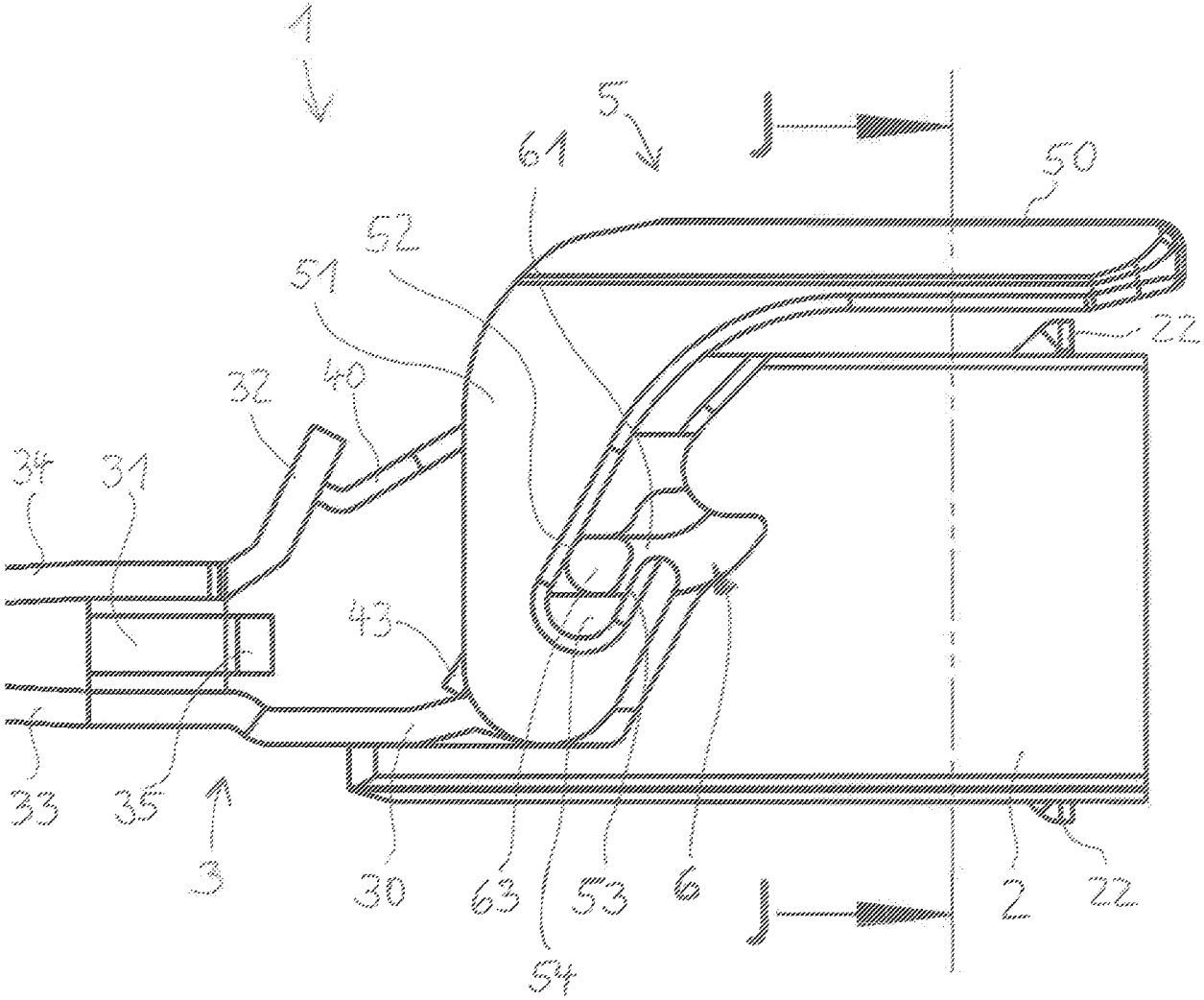
FIG. 2 shows the conductor connection terminal according to FIG. 1 in sections in a side view.

The actuating contour 53 serves to apply force to the control element 6 via the connecting pin 63 when the actuating element 5 is moved from the closed position to an open position, which is shown in FIGS. 1 and 2, and in this way to press said control element against the clamping leg 43 of the clamping spring 4. In the return movement, i.e. when the actuating element 5 moves from the open position to the closed position, the control element 6 is acted upon with force via the connecting pin 63 by means of the restoring contour 52, wherein part of the restoring force can also be applied by the clamping spring 4.

Figure 3:
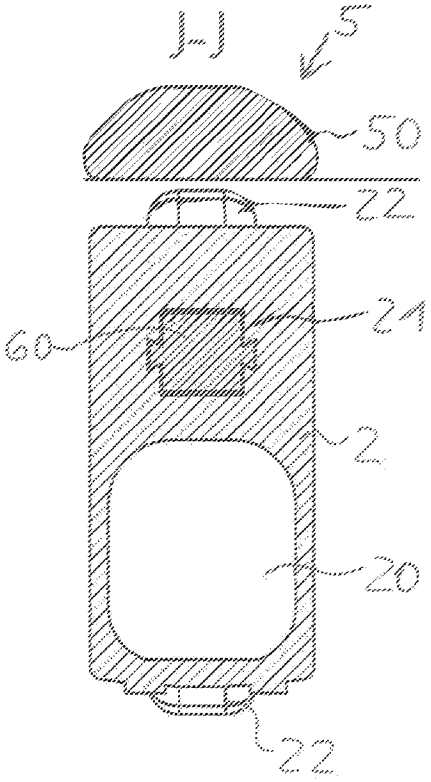
FIG. 3 shows a sectional view of the conductor connection terminal according to the sectional plane J-J shown in FIG. 2.

On the basis of the sectional plane J-J, FIG. 3 shows that the control element 6 extends with a guide extension 60 into a guide contour 21, which can be formed, for example, in the material of the housing part 2. By means of the guide contour 21, the control element 6 with its guide extension 60 is guided in a defined manner in the direction of movement from the open position into the closed position, and vice versa.

Figure 4:
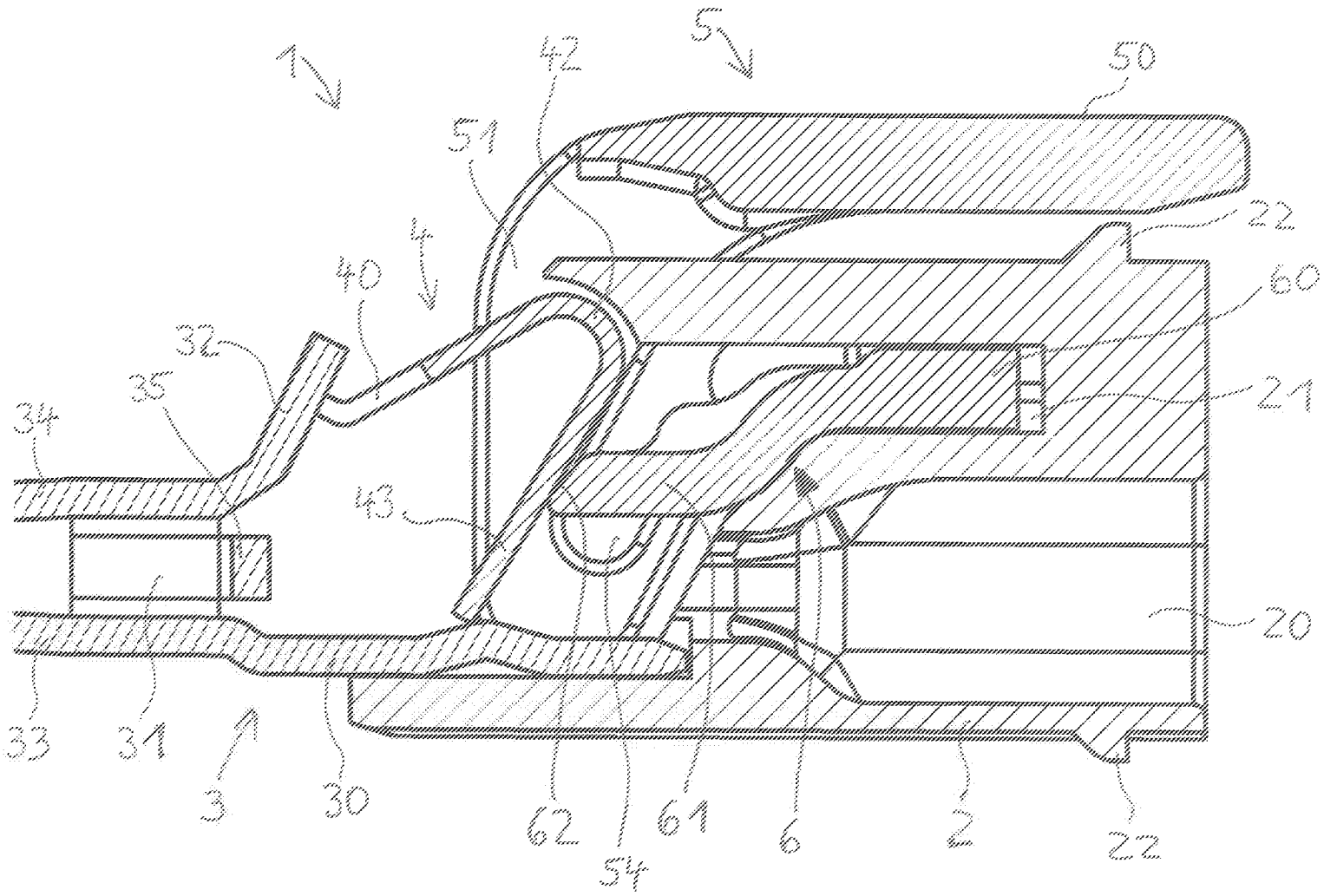
FIGS. 4 to 6 show sectional side views of the section of the conductor connection terminal shown in FIG. 2.

FIG. 4 further clarifies the guidance of the control element 6 by means of the guide extension 60 and the guide contour 21 using the sectional illustration.

It is also clear that the control element 6 may have a stepped shape, in which a section 61 of the control element 6 facing the clamping leg 43 of the clamp spring 4, at whose free end an impingement area 62 is provided for applying force to the clamping spring 4, is arranged closer to a conductor insertion channel 20 than the guide extension 60. In this way, the area of the housing part 2, which is further spaced from the conductor insertion channel 20, can be used for guiding the control element 6, whereas the force applied to the clamping spring 4 by the impingement area 62 takes place further down in a kinematically more favorable manner, i.e. closer to the free end of the clamping leg 43, so that there is a greater leverage effect.

As can be seen, the housing part 2 also has a conductor insertion channel 20 which extends from a conductor insertion opening into the interior of the housing part 2 towards the clamping point. An electrical conductor can thus be introduced from a conductor connection side L through the conductor insertion channel 20 and clamped at the clamping point between the free end of the clamping leg 43 and the busbar section 30. The electrical conductor is then located between the busbar section 30, which has the clamping point, and the control element 6.

It can also be seen that the clamping spring extends from the contact leg 40, which, as mentioned, is fastened to the holding section 32 of the busbar 3 via a spring arc 42 to the clamping leg 43.

Figure 5:
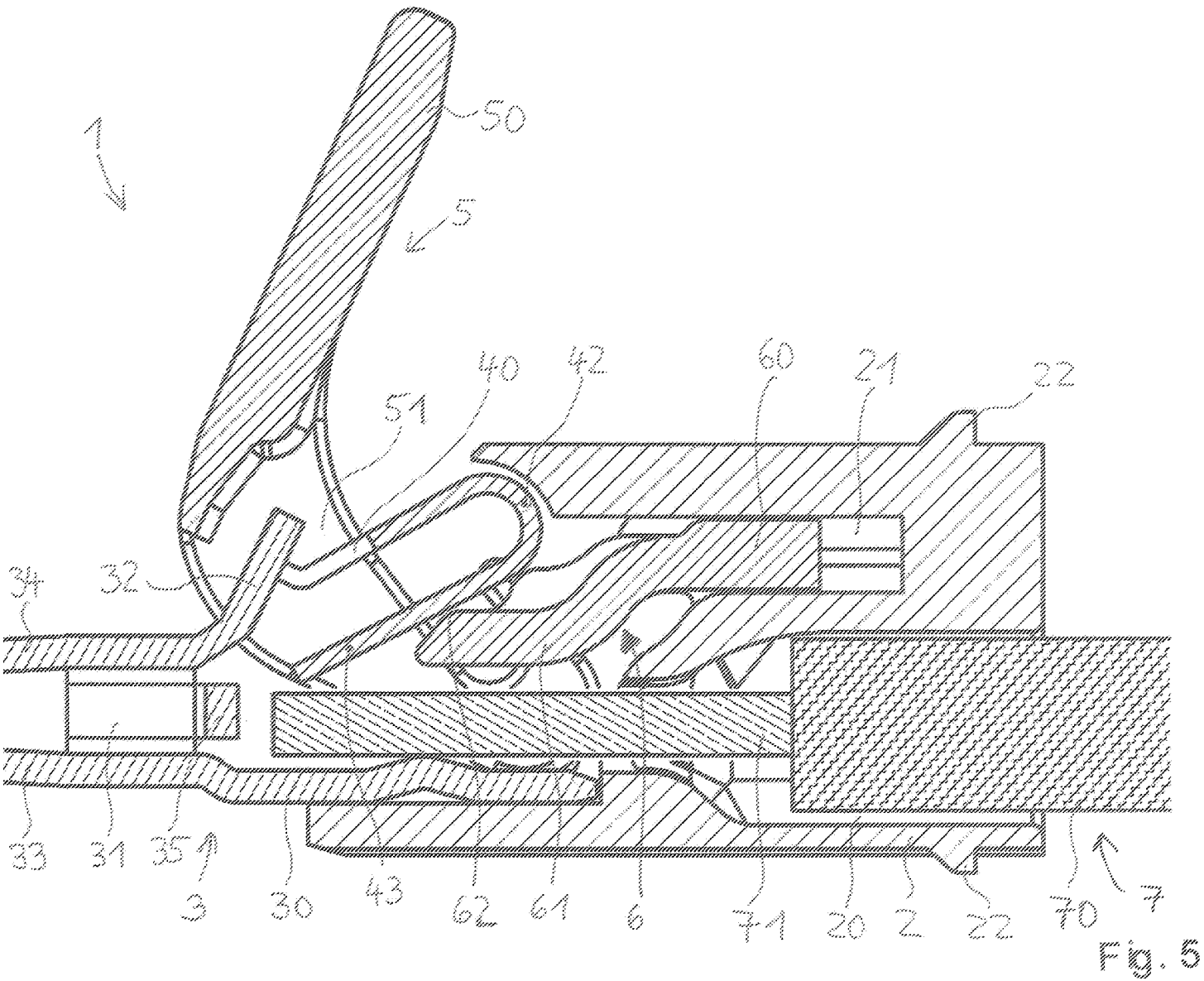

FIGS. 1 to 4 show the conductor connection terminal with an actuating element 5 in each case in the closed position. FIG. 5 shows the conductor connection terminal 1 with the actuating element in the open position. As can be seen, the actuating element 5 has been pivoted counterclockwise in the drawing. Via the connection arrangement formed by means of the connecting pin 63 and the pin receptacle 54, the control element 6 was displaced via the actuating contour 53 in a linear movement to the left into an actuating position. Here, the impingement area 62 has applied force to the clamping leg 43 and deflected it into the position shown in FIG. 5, in which the clamping leg 43 is no longer in contact with the busbar section 30, but is spaced from it so that an electrical conductor 7 can be led to the clamping point. As can be seen, the electrical conductor has an insulation 70 in which an electrically conductive core 71 is located. This core 71 is free from insulation 70 at the free end, so that electrical contact can be established between the core 71 and the busbar section 30.

Figure 6:
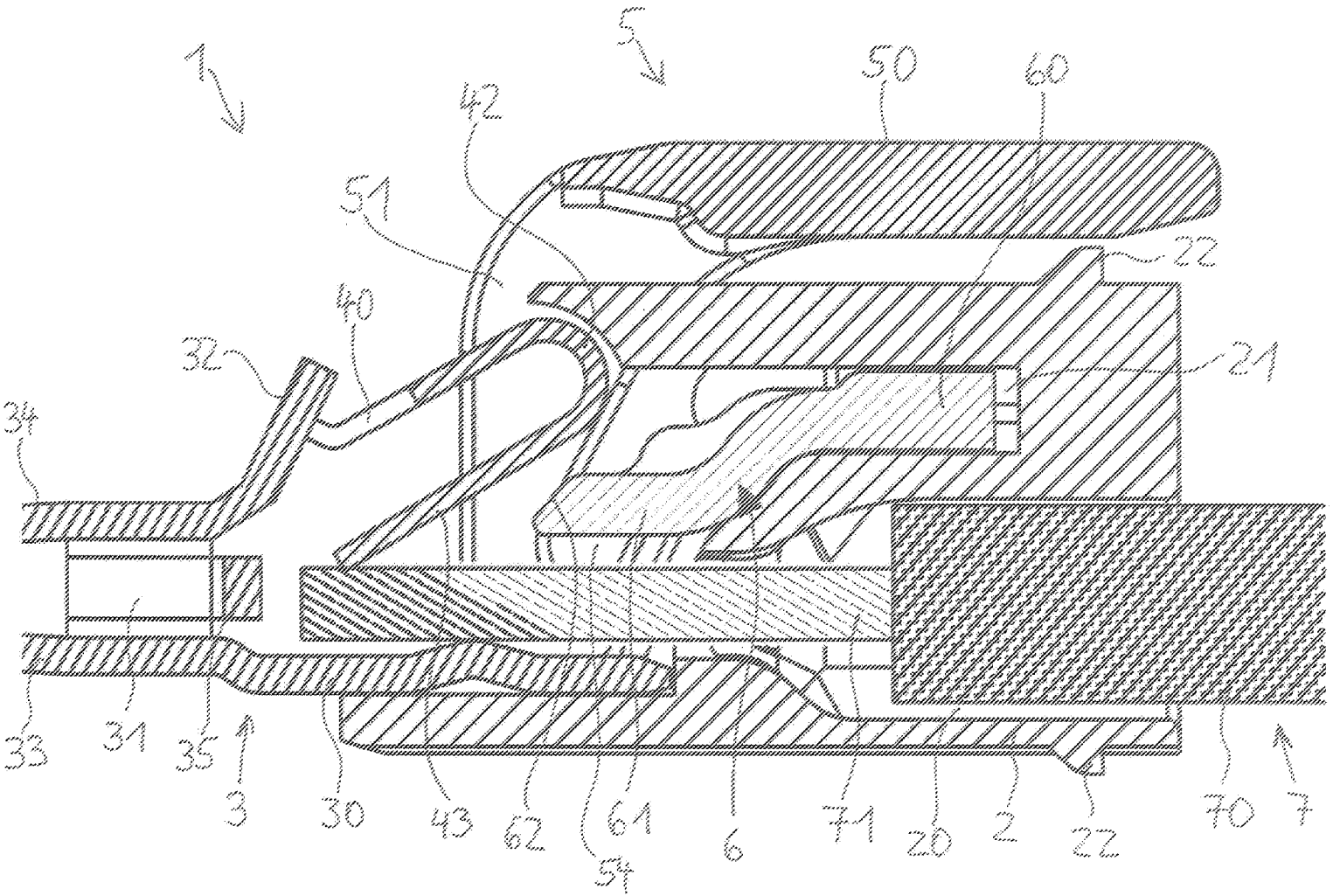

FIG. 6 shows the arrangement according to FIG. 5, wherein the actuating element 5 has now been moved back to the closed position. As a result, the control element 6 has also been moved back to the original starting position, as shown in FIG. 4. It can be seen that the clamping spring 4 or the clamping leg 43 no longer rests against the impingement area 62, but rests against the core 71 of the electrical conductor 7 via its free end and presses the latter against the busbar section 30. Due to the restoring contour 52, the control element 6 has nevertheless been completely moved to its closed position.

Figure 7:
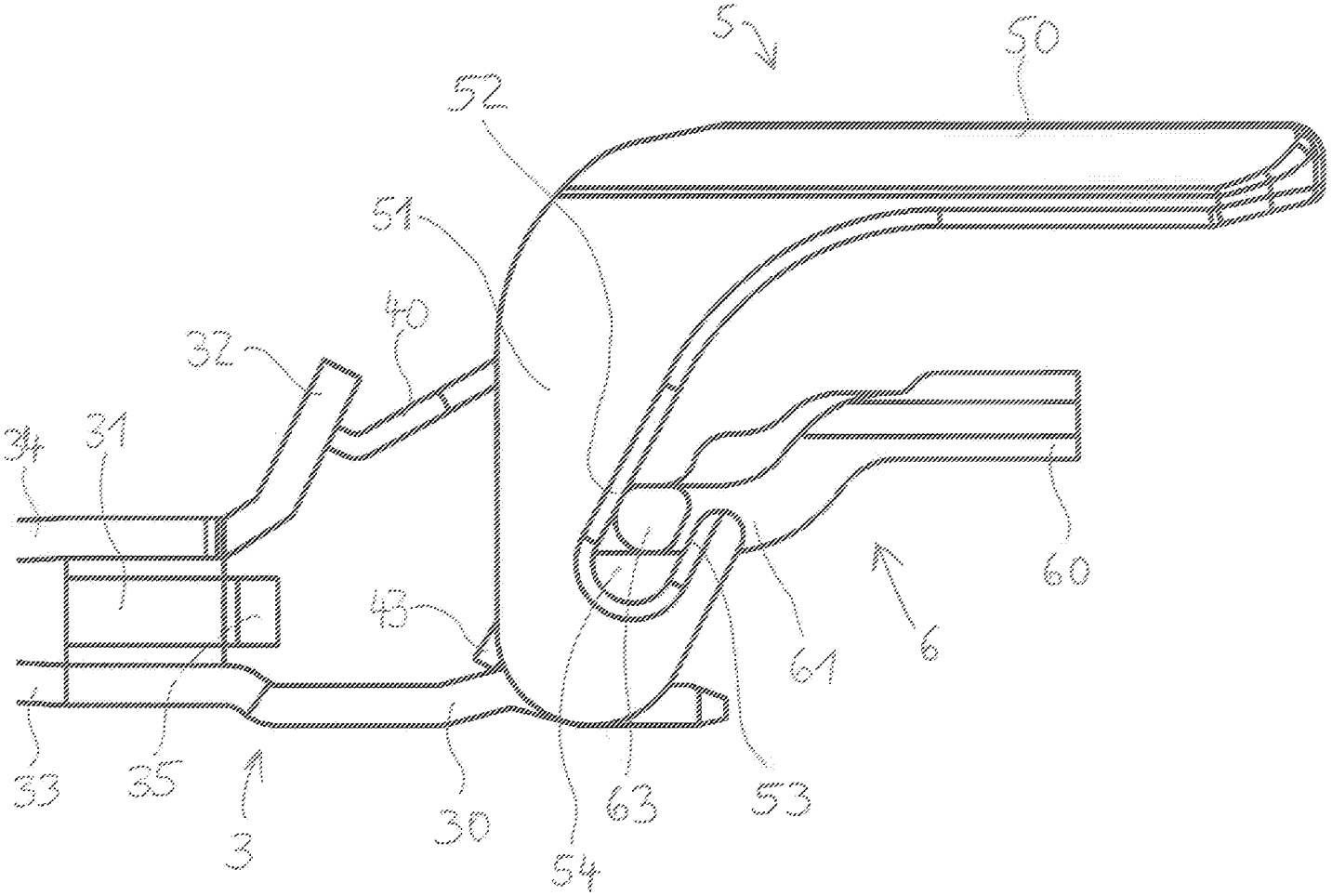
FIGS. 7 to 8 show side views of parts of the conductor connection terminal.
Figure 8:
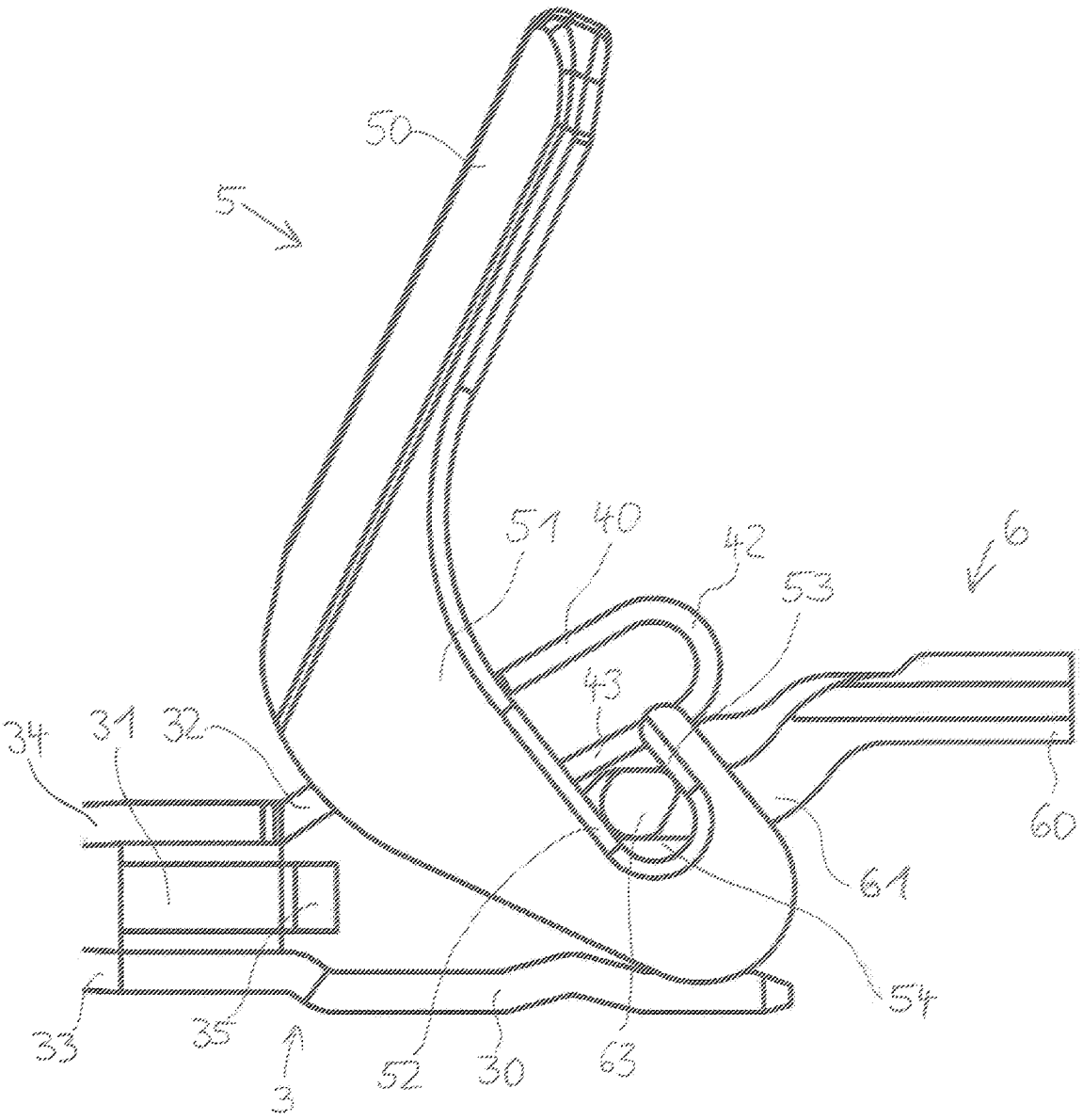

The aim of FIGS. 7 and 8 is to illustrate the kinematics of the actuating element 5, the control element 6 and the clamping spring 4. Compared to the figures explained so far, the housing part 2 has been removed. It becomes clear that the control element 6 must necessarily follow a movement of the actuating element 5 via the connection arrangement with the connecting pin 63 and the pin receptacle 54. During the movement from the closed position of the clamping spring 4 to the open position of the clamping spring 4, the control element 6 is moved over the actuating contour 53 of the actuating element 5, in the case of the return movement over the restoring contour 52.

Figure 9:
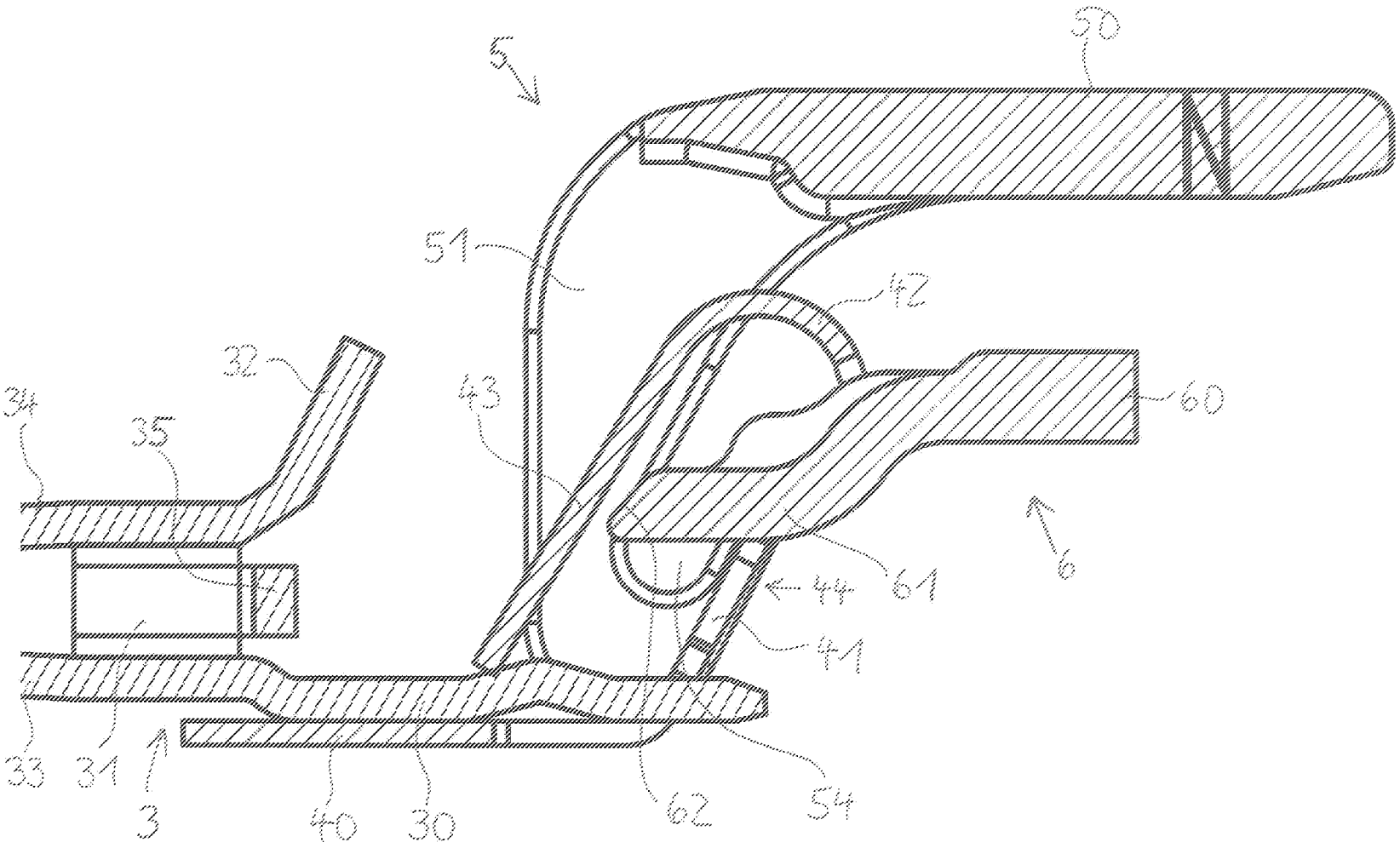
FIG. 9 shows a sectional side view of a further embodiment of a conductor connection terminal.

FIG. 9 shows, on the basis of a representation that is comparable to FIG. 4, wherein the housing part 2 is not shown, an embodiment of the conductor connection terminal 1 with a different design of the clamping spring 4. In this case, the loop-shaped clamping spring 4 has a contact leg 40, which is held 43 on the busbar section 30 on the side of the busbar section 30 facing away from the clamping leg.

The clamping spring 4 extends from the contact section 40 via a connecting section 41 to the spring arc 42, to which the clamping leg 43 is connected. Since with such a construction of the clamping spring 4, the connecting leg 41 is technically in the way of the insertion of the electrical conductor 7, the connecting section 41 has a recess 44 through which the electrical conductor 7 can extend. In addition, the control element 6 is also passed through the recess 44 so that the control element 6 can actuate the clamping leg 43 via its impingement area 62 in the manner already explained.

As already mentioned, the housing of the conductor connection terminal 1 can be designed as a multi-part housing in which the housing part 2 represents only one part. As is shown by way of example with reference to FIGS. 10 and 11, the housing can, for example, have a further housing part 23, which can also be referred to as the main housing part of the housing. The housing part 2 is connected to the further housing part 23, for example by inserting the housing part 2, together with the busbar 3, the spring-loaded clamping connection 4 and the control element 6, into a receiving chamber of the further housing part 23. In this case, the actuating element 5 can already be connected to the assembly formed from the parts 2, 3, 4 and 6 or can be inserted subsequently. The housing part 2 can, for example, have locking elements 22, which lock the housing part 2 with corresponding locking recesses of the other housing part 23 that are formed as counterparts.

The housing of the conductor connection terminal 1, in particular housing part 2 and further housing part 23, can for example be formed from an insulating material. The housing of the conductor connection terminal 1 is then an insulating material housing.

Figure 10:
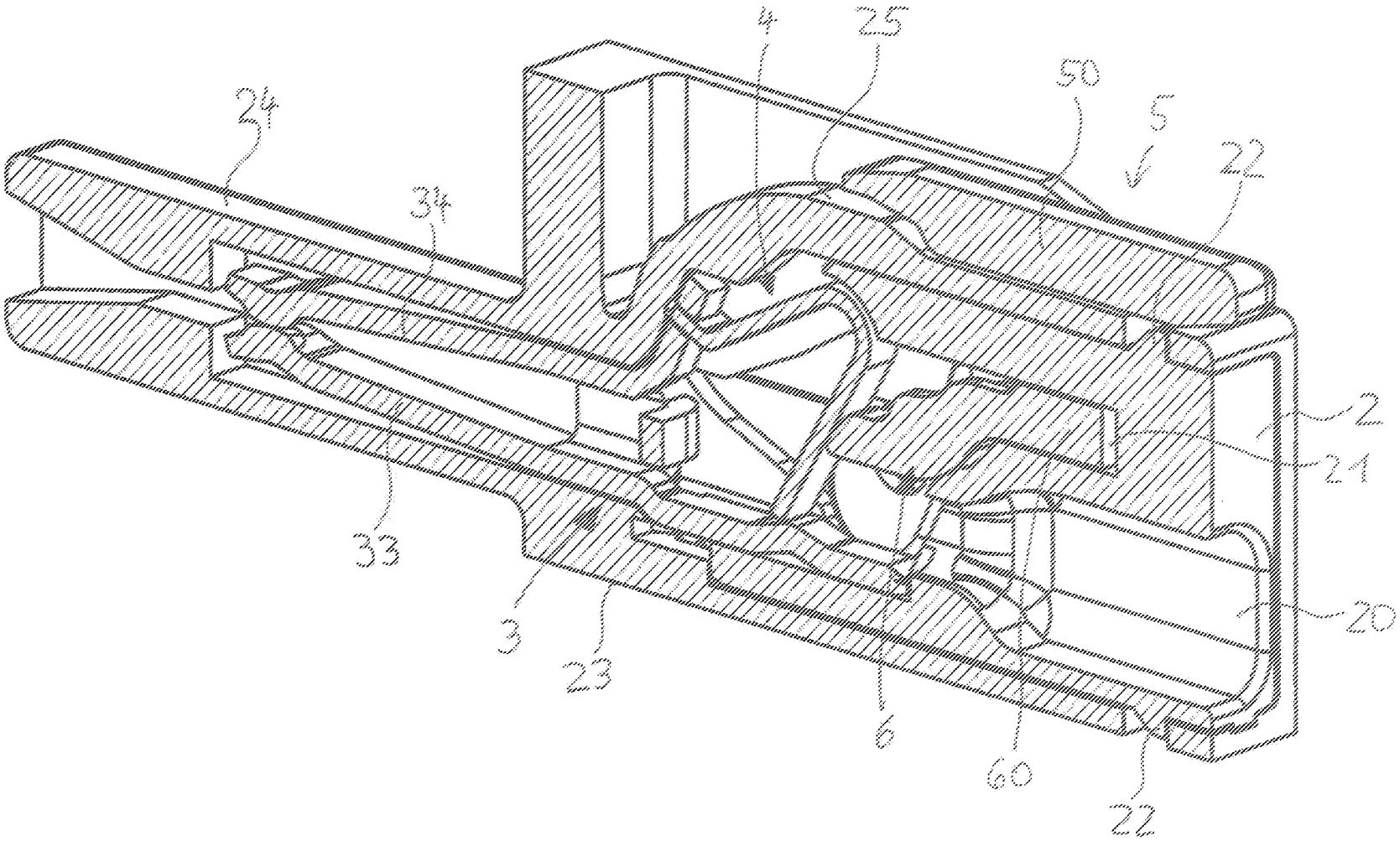
FIG. 10 shows a longitudinal section through a conductor connection terminal in a perspective view.
Figure 11:
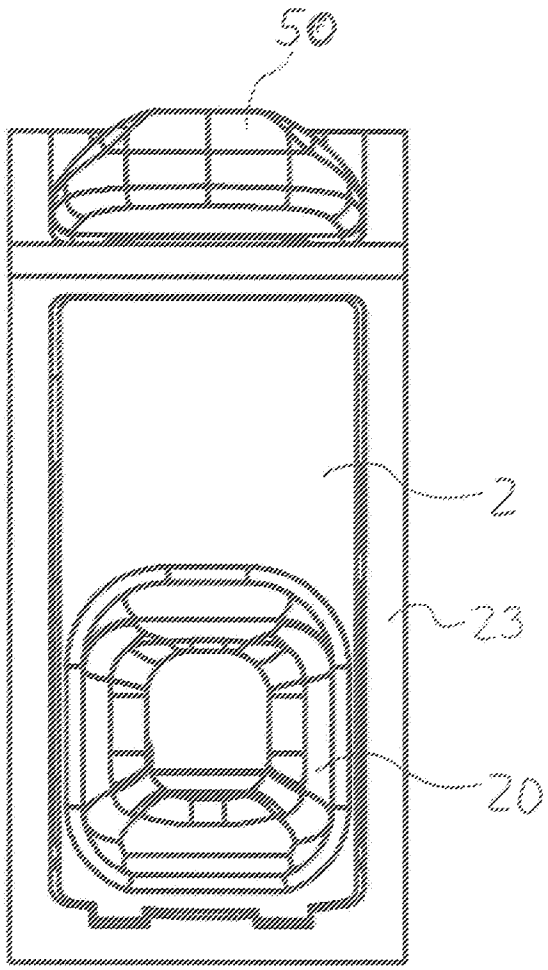
FIG. 11 shows the conductor connection terminal according to FIG. 10 in a plan view of the conductor connection side.

As can be seen from FIG. 10, the housing or the further housing part 23 can have a plug-in section 24 in which the contact tongues 33, 34 are received. The further housing part 23 can also have a cover wall 25, which covers parts of the clamping spring 4 and/or the busbar 3 in an insulating manner. The cover wall 25 can extend, for example, into an area between an upper wall of the housing part 2 and the actuating section 50 of the actuating element 5. The actuating element 5 then extends laterally past this cover wall 25 with its connecting sections 51.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

at least one spring-loaded clamping connection for connecting an electrical conductor via a spring-loaded clamping, the spring-loaded clamping connection comprises at least one clamping point for clamping the electrical conductor which is formed with a clamping leg of a clamping spring;

a manual actuating element, which, as a result of manual actuation, is adapted to be moved from at least a closed position, in which the at least one clamping point is closed, to an open position, in which the at least one clamping point is open, and vice versa;

a movably mounted control element via which the manual actuating element is mechanically coupled to the clamping spring so that, as a result of manual actuation of the manual actuating element, the at least one clamping point is adapted to be opened and closed via the control element; and a restoring contour arranged on the manual actuating element, the restoring contour, which, at least when moving the manual actuating element from the open position to the closed position, comes into contact with the control element, wherein the control element is movable from the open position to the closed position by the restoring contour, wherein the manual actuating element is coupled to the control element via a connection arrangement that includes at least one connecting pin that protrudes from the control element and a pin receptacle provided in the manual actuating element, wherein the at least one connecting pin of the control element engages in the pin receptacle of the manual actuating element, and wherein the pin receptacle has an elongated groove or an elongated slot, wherein the at least one connecting pin is guided longitudinally in the elongated groove or the elongated slot.

2. The conductor connection terminal according to claim 1, wherein the clamping spring exerts a restoring force on the control element at least in some areas, via which a restoring movement of the control element from the open position to the closed position caused by the restoring contour is at least partially supported.

3. The conductor connection terminal according to claim 1, wherein the control element is completely shielded from the outside environment by components of the conductor connection terminal.

4. The conductor connection terminal according to claim 1, wherein the manual actuating element has a manual actuation section and a connecting section, which projects from the manual actuation section and is coupled with the control element.

5. The conductor connection terminal according to claim 1, wherein the conductor connection terminal has a guide contour for forcibly guiding the movement of the control element.

6. The conductor connection terminal according to claim 5, wherein the guide contour is designed as a linear guide or an arcuate guide.

7. The conductor connection terminal according to claim 5, wherein the conductor connection terminal has a conductor insertion channel through which an electrical conductor to be connected is adapted to be inserted into the conductor connection terminal and guided to the at least one clamping point.

8. The conductor connection terminal according to claim 7, wherein the control element comprises an impingement area which applies a force on the clamping spring, and wherein the impingement area is disposed closer to a center axis of the conductor insertion channel than the guide contour.

9. The conductor connection terminal according to claim 7, wherein the control element is arranged on a side of the conductor insertion channel that opposes the clamping point.

10. The conductor connection terminal according to claim 9, wherein the clamping spring has a contact leg via which the clamping spring is supported against a clamping force of a clamping leg, and wherein the contact leg is fixed on the busbar or with a component coupled with the busbar.

11. The conductor connection terminal according to claim 1, wherein the conductor connection terminal comprises a busbar, on which an electrical conductor is adapted to be clamped at the at least one clamping point via the clamping spring.

12. The conductor connection terminal according to claim 1, wherein the control element is adapted to be moved predominantly in a translatory manner and the manual actuating element is adapted to be moved predominantly in a rotary manner.

13. A conductor connection terminal comprising:

at least one spring-loaded clamping connection for connecting an electrical conductor via a spring-loaded clamping, the spring-loaded clamping connection comprises at least one clamping point for clamping the electrical conductor which is formed with a clamping leg of a clamping spring;

a manual actuating element, which, as a result of manual actuation, is adapted to be moved from at least a closed position, in which the at least one clamping point is closed, to an open position, in which the at least one clamping point is open, and vice versa;

a movably mounted control element via which the manual actuating element is mechanically coupled to the clamping spring so that, as a result of manual actuation of the manual actuating element, the at least one clamping point is adapted to be opened and closed via the control element; and a restoring contour arranged on the manual actuating element, the restoring contour, which, at least when moving the manual actuating element from the open position to the closed position, comes into contact with the control element, wherein the control element is movable from the open position to the closed position via the restoring contour, and wherein the clamping spring has at least one recess through which the control element extends at least in certain positions.

14. A conductor connection terminal comprising:

at least one spring-loaded clamping connection for connecting an electrical conductor via a spring-loaded clamping, the spring-loaded clamping connection comprises at least one clamping point for clamping the electrical conductor which is formed with a clamping leg of a clamping spring;

a manual actuating element, which, as a result of manual actuation, is adapted to be moved from at least a closed position, in which the at least one clamping point is closed, to an open position, in which the at least one clamping point is open, and vice versa;

a movably mounted control element via which the manual actuating element is mechanically coupled to the clamping spring so that, as a result of manual actuation of the manual actuating element, the at least one clamping point is adapted to be opened and closed via the control element; and a restoring contour arranged on the manual actuating element, the restoring contour, which, at least when moving the manual actuating element from the open position to the closed position, comes into contact with the control element, wherein the control element is movable from the open position to the closed position by the restoring contour, wherein the manual actuating element is coupled to the control element via a connection arrangement that includes at least one connecting pin that protrudes from the control element and a pin receptacle provided in the manual actuating element, wherein the at least one connecting pin of the control element engages in the pin receptacle of the manual actuating element, wherein the manual actuating element has a manual actuation section and a connecting section, which projects from the manual actuation section and is coupled with the control element, and wherein the connecting section runs laterally along the clamping spring.

15. A conductor connection terminal comprising:

at least one spring-loaded clamping connection for connecting an electrical conductor via a spring-loaded clamping, the spring-loaded clamping connection comprises at least one clamping point for clamping the electrical conductor which is formed with a clamping leg of a clamping spring;

a manual actuating element, which, as a result of manual actuation, is adapted to be moved from at least a closed position, in which the at least one clamping point is closed, to an open position, in which the at least one clamping point is open, and vice versa;

a movably mounted control element via which the manual actuating element is mechanically coupled to the clamping spring so that, as a result of manual actuation of the manual actuating element, the at least one clamping point is adapted to be opened and closed via the control element; and a restoring contour arranged on the manual actuating element, the restoring contour, which, at least when moving the manual actuating element from the open position to the closed position, comes into contact with the control element, wherein the control element is movable from the open position to the closed position by the restoring contour, and wherein the control element is completely shielded from the outside environment by components of the conductor connection terminal.

* * * * *